United States Patent [19]

Koch

[11] Patent Number: 4,971,265

[45] Date of Patent: Nov. 20, 1990

[54] MANDREL FOR COILING TAPE-SHAPED MATERIAL

[75] Inventor: Ulf Koch, Eberbach, Fed. Rep. of Germany

[73] Assignee: Esselte Meto International Produktions GmbH, Hirschhorn, Fed. Rep. of Germany

[21] Appl. No.: 239,286

[22] Filed: Sep. 1, 1988

[30] Foreign Application Priority Data

Sep. 4, 1987 [DE] Fed. Rep. of Germany ..... 3729747

[51] Int. Cl.[5] ..... B65H 18/08; B65H 75/22

[52] U.S. Cl. ..... 242/72 R; 242/68.5

[58] Field of Search ..... 242/68.5, 72 R, 78.1, 242/71.8, 118, 68.2, 72.1

[56] References Cited

U.S. PATENT DOCUMENTS

| | | | |
|---|---|---|---|
| 3,396,918 | 8/1968 | Adamson et al. | 242/72 |
| 3,837,690 | 9/1974 | Fraser, Jr. et al. | 242/68.5 X |
| 4,119,280 | 10/1978 | Sato | 242/68.5 |
| 4,254,918 | 3/1981 | Huggins | 242/68.5 |
| 4,323,202 | 4/1982 | Lauerty | 242/68.5 |
| 4,802,637 | 2/1989 | Williams | 242/72 R |

FOREIGN PATENT DOCUMENTS

| | | | |
|---|---|---|---|
| 2810163 | 9/1979 | Fed. Rep. of Germany | 242/68.5 |
| 2906858 | 4/1980 | Fed. Rep. of Germany . | |
| 2906856 | 9/1980 | Fed. Rep. of Germany . | |

*Primary Examiner*—Joseph J. Hail, III
*Assistant Examiner*—Paul Thomas Bowen
*Attorney, Agent, or Firm*—Sixbey, Friedman, Leedom & Ferguson

[57] ABSTRACT

A mandrel for coiling tape-shaped material includes a core (10) which is adapted to be connected at one end to a drive (36). Disposed on the core (10) is a sleeve (44) having a length which corresponds to the length of the core (10) and comprising at least one longitudinal slot (46 to 56), the sleeve being displaceable in axial direction but secured against rotation relatively to the core (10).

13 Claims, 4 Drawing Sheets

MANDREL FOR COILING TAPE-SHAPED MATERIAL

Figure 2:
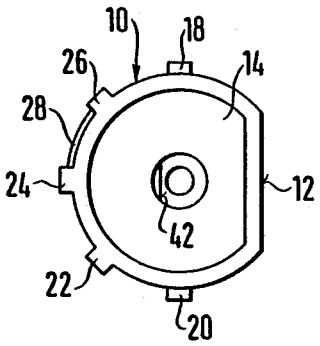

The invention relates to a mandrel for coiling tape-shaped material comprising a core connectable at one of its ends to a drive means and a sleeve which is non-rotatably mounted on said core and is movable on the core between a coiling position and a removal position for removing a roll of the tape-like material formed on the sleeve.

German Pat. No. 2,906,856 discloses a hand appliance for dispensing and attaching labels adhering to a carrier band in which the carrier band after attachment of the labels to an article is wound on a mandrel which comprises a core and a sleeve displaceable thereon. At the outer surface of the sleeve clamping fingers are attached which can hold the carrier band end so that at the beginning of the coiling or winding up operation no slipping of the band occurs and a tight roll package is formed. The package formed must be removed from time to time because only a limited amount of space is available in the appliance. For this purpose the sleeve can be displaced on the core in such a manner that it projects out of the housing side wall, whereupon the roll formed thereon can be removed. However, in this appliance the roll is very tightly formed on the sleeve so that it cannot be removed as a whole but is deformed very greatly in funnel-like manner, firstly the outer roll layers and finally the inner roll layers sliding from the sleeve. The resulting destruction of the roll is of no consequence in the known appliance because the carrier band forming the roll is no longer required and is discarded.

However, there are label printing appliances or devices in which self-adhering labels with optionally settable information can be printed. The self-adhering labels are disposed on a carrier band which is attached to a supply roll. The carrier band is supplied with the self-adhesive labels adhering thereto from the supply roll to a printing table where the labels are then provided with the desired imprint. After the imprinting the carrier band is supplied to a mandrel which is driven by a motor and onto which the carrier band is wound with the imprinted self-adhering labels. Thus, a roll pack forms on the mandrel which when a predetermined diameter has been reached must be removed from the mandrel.

The known mandrel outlined above cannot be used in such a label printing device because when the roll is removed from said mandrel the problem already outlined occurs that the roll is deformed in funnel shape because the innermost layer is too tightly fitted on the mandrel. Since however the roll with the imprinted self-adhering labels must be further used in a label dispensing device said roll should remain as stable as possible so that it can be inserted into the label dispensing device immediately without any subsequent coiling possibly to be done by hand.

The invention is based on the problem of providing a mandrel of the type outlined for coiling tape-shaped material which with simple structure permits very easy removal of the roll formed thereon.

This problem is solved according to the invention in that the sleeve is provided with at least one slot which is formed in the sleeve in such a manner that the sleeve diameter can be at least partially reduced in the removal position.

With the mandrel according to the invention the roll formed can be removed very easily from the sleeve after displacement of the sleeve into the removal position because the slot formed therein, permitting radial yielding of the sleeve, relieves the innermost roll layers so that the innermost layers no longer tightly engage the sleeve. The lateral removal of the pack thus formed can thus be carried out without any danger of the innermost roll layers moving in funnel manner out of the roll.

Advantageous further developments of the invention are as follows: a relative displacement between the roll and the sleeve during displacement of the sleeve on the core is prevented; a further development ensures that the sleeve does not detach itself completely from the core during the axial displacement but remains connected to the core even in the state of maximum displacement; a further development permits threading of the end of the tape-shaped material to be coiled into the mandrel and to securely hold the end until the convolutions of the roll formed prevent the end from sliding out of the mandrel; further features ensure that the sleeve does not move relatively to the core during the coiling operation because the detent requires overcoming a certain detent force which must be applied to perform the axial displacement.

Figure 1:
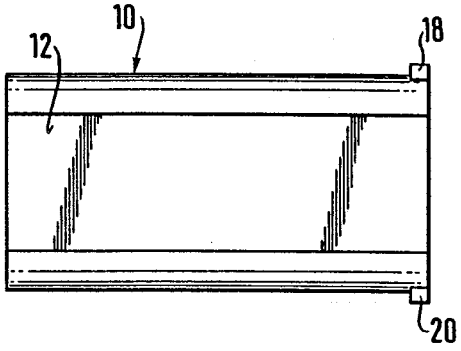
Figure 3:
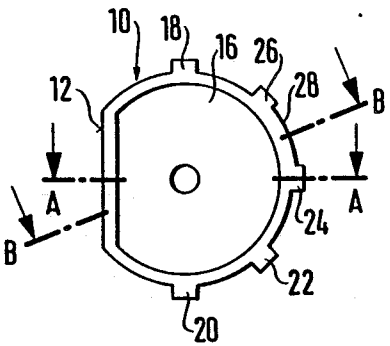
Figure 4:
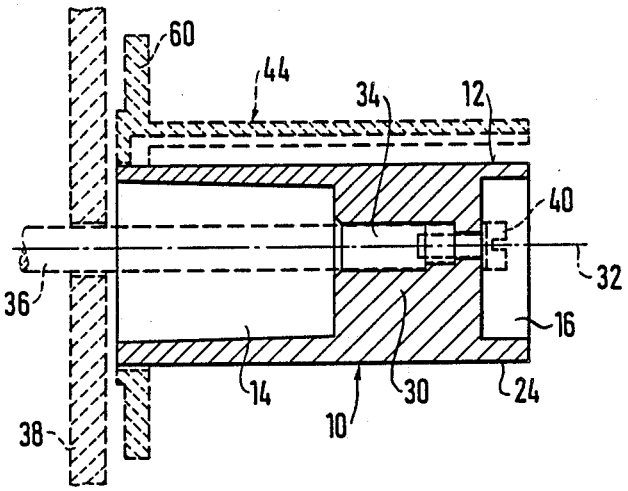
Figure 5:
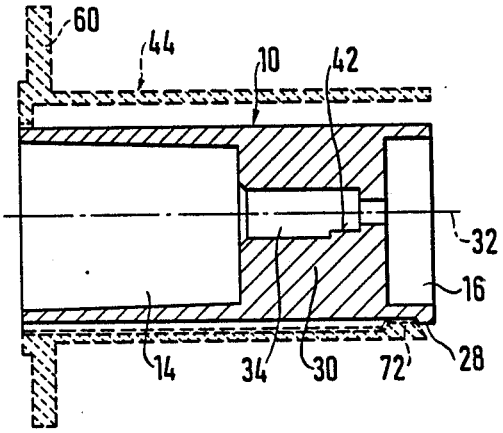
Figure 7:
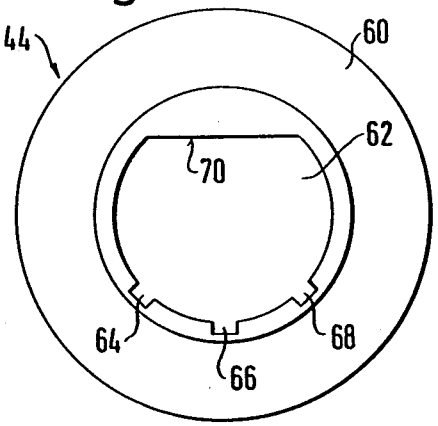
Figure 6:
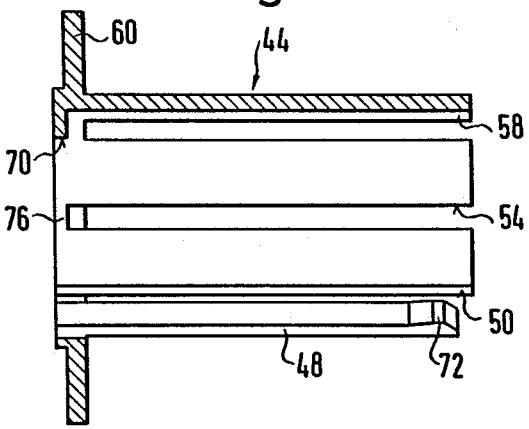
Figure 9:
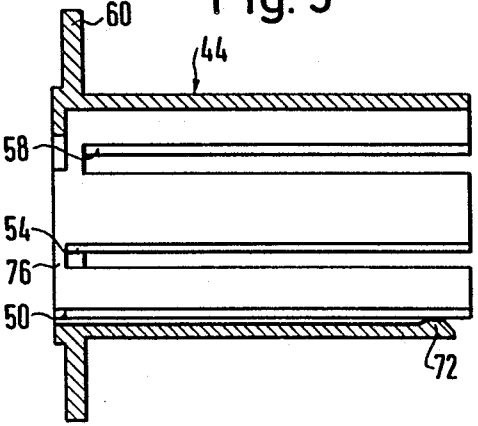
Figure 8:
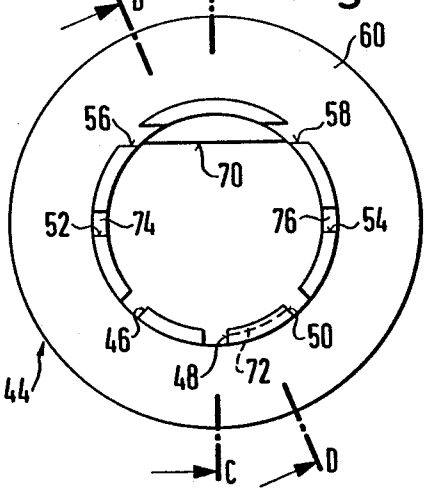
Figure 10:
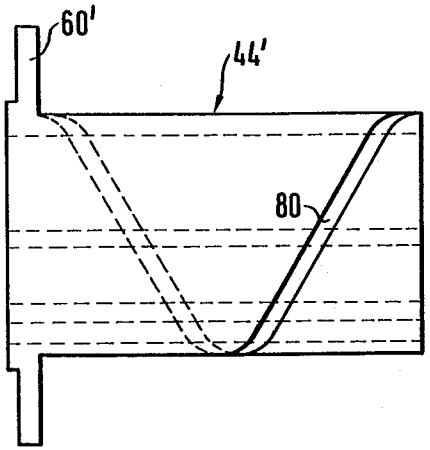
Figure 11:
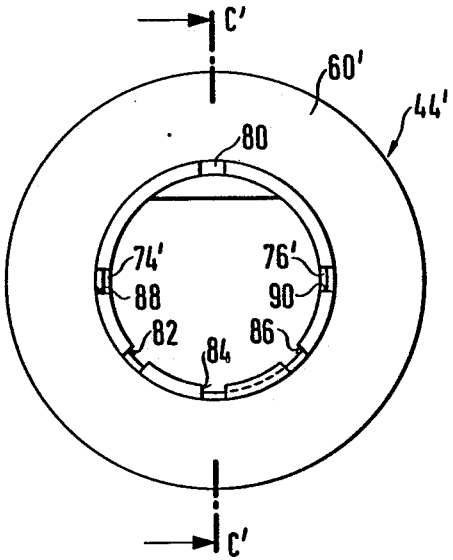

The invention will now be explained by way of example with the aid of the drawings, wherein:

FIG. 1 is a side elevation of the core of the mandrel according to the invention, FIG. 2 is an end elevation of the core of FIG. 1 seen from the left, FIG. 3 is an end elevation of the core of FIG. 1 seen from the right, FIG. 4 is a section along the line A—A of FIG. 3, FIG. 5 is a section along the line B—B of FIG. 3, FIG. 6 is a section of the sleeve of the mandrel according to the invention along the line C—C of FIG. 8, FIG. 7 is an end elevation of the sleeve of FIG. 6 seen from the left, FIG. 8 is an end elevation of the sleeve of FIG. 7 seen from the right, FIG. 9 is a section along the line D—D of FIG. 8, FIG. 10 is a section of a further embodiment of the sleeve along the line C'—C' of FIG. 11 and FIG. 11 is an end elevation of the sleeve of FIG. 10.

In FIG. 1 the core 10 of the mandrel to be described for coiling strip-shaped material is illustrated in a side elevation. Said core 10 consists of a substantially cylindrical base body which has a flattened portion 12 as can readily be seen in FIGS. 2 and 3. As apparent from the sectional views of FIGS. 4 and 5 the core 10 is hollowed out from both sides, mainly to save weight, so that the inner cavities 14 and 16 are formed. At the end on the right in FIG. 1 the core 10 is provided at its outer peripheral face with two diametrically opposite noses 18 and 20 of which the purpose will be explained in detail hereinafter. In addition the core 10 comprises at its outer peripheral face three longitudinal ribs 22, 24 and 26. At the end on the right in FIG. 1 at the region lying between the longitudinal ribs 24 and 26 a projection 28 is disposed of which the purpose will also be explained in detail hereinafter.

The solid region 30 of the core 10 lying between the two inner cavities 14 and 16 is provided with a bore 34 which extends centrally of the core axis 32 and the diameter of which from the side of the inner cavity 14 is greater than from the side of the inner cavity 16. In FIG. 4 the dashed lines indicate how the core 10 can be disposed on a drive spindle 36 which projects out of the wall 38 of a device not shown. A screw 40 screwed from the side of the inner cavity 16 into the end face of the drive spindle 36 serves to secure the core 10 on the drive spindle 36. A relative rotation between the drive spindle 36 and the core 10 is prevented in that the bore 34 has a flattened portion 42 which cooperates with a correspondingly flattened portion at the end of the drive spindle 36.

The sleeve 44 illustrated in section in FIG. 6 comprises a plurality of longitudinal slots 46, 48, 50, 52, 54, 56, 58. At the end lying on the right in FIG. 6 these longitudinal slots are open so that the regions of the outer peripheral face of the sleeve 44 lying between the longitudinal slots form fingers which can each yield in the radial direction.

At the end lying on the left in FIG. 6 the sleeve 44 is provided with an annular flange 60 which holds the individual portions of the sleeve 44 lying between the longitudinal slots together. The annular flange 60 comprises at its end shown in the end elevation in FIG. 7 an opening 62 which surrounds the core 10 including the longitudinal ribs 22, 24 and 26 disposed thereon in the manner of a template. For receiving the longitudinal ribs 22, 24 and 26 the opening 62 has corresponding recesses 64, 66 and 68. The recesses 64, 66 and 68 and the straight region of the outline of the opening 62 corresponding to the flattened portion 12 on the core ensure that the core 10 cannot be turned relatively to the sleeve 44 when it is disposed in the interior of said sleeve 44. In FIGS. 4 and 5 the manner in which the core 10 can be fitted in the interior of the sleeve 44 is indicated in dashed lines.

Formed at the end of the region of the outer peripheral face lying between the longitudinal slots 48 and 50 is a detent nose 72 which cooperates with the projection 28 on the core. Because of the cooperation of the detent nose 72 with the projection 28 the sleeve 44 cannot be displaced relatively to the core 10 to the right according to FIG. 5 until a predetermined detent force has been overcome.

When the sleeve is mounted on the core in the manner shown in dashed line in FIGS. 4 and 5 said sleeve can be displaced in the axial direction to the right by overcoming the detent force exerted by the detent nose 72. The noses 18 and 20 then slide in the longitudinal slots 52 and 54 in the sleeve 44. Withdrawal of the sleeve 44 from the core 10 is however not possible because the longitudinal slots 52 and 54 are closed at their end lying adjacent the annular flange 60 with the aid of stop webs 74 and 76. This is moreover also apparent from the end elevation of FIG. 7 in which it can be seen that the opening 62 does not have any recesses like the recesses 64, 66 and 68 in the regions in which the longitudinal slots 52 and 54 lie.

For carrying out a coiling operation the sleeve 44 is brought relatively to the core 10 into the coiling position illustrated in dashed lines in FIGS. 4 and 5. The free end of the tape-shaped material to be wound up is then pushed through one of the two slots 56, 58 into the interior of the sleeve 44. The drive spindle 36 is then set in rotation by a motor, not shown, and as a result the sleeve 44 connected to the core 10 rotates with said core 10 which is non-rotatably connected to the drive spindle 36. Since the free end of the tape-shaped material is inserted into one of the slots 56 or 58 said free end is entrained on rotation so that the coiling operation starts. During said coiling operation the tape-shaped material comes to lie relatively tightly round the outer peripheral surface of the sleeve 44 and a roll with increasing diameter is formed. As soon as the desired size of the roll on the sleeve 44 is reached the rotation is stopped and the roll formed is displaced on the core 10 together with the sleeve to the right in the illustration of FIGS. 4 and 5 until the noses 18 and 20 come to bear on the stop webs 74, 76 on the sleeve 44. Since the sleeve 44 is no longer supported in its interior by the core 10 in this removal position the regions of the sleeve 44 lying between the longitudinal slots 46 to 56 can yield radially inwardly so that the roll formed on the sleeve can be removed from the sleeve in the axial direction easily and almost without any resistance. The roll pack is not deformed when this is done and can therefore be supplied to the further use without additional steps such as straightening.

To prepare for a new coiling operation the sleeve 44 is again inserted into the coiling position on the core 10 until the detent nose 72 has slid past the projection 28 on the core 10 so that the sleeve 44 is reliably held in the coiling position for the next coiling operation.

To obtain the radial yieldability of the sleeve which facilitates removal of the roll in the axial direction in the removal position of said sleeve, instead of the longitudinal slots of the embodiment of the sleeve described so far one slot can be provided which extends along a helical line round the sleeve. This embodiment is shown in FIG. 10 in which the same reference numerals with an apostrophe added are employed for the same corresponding parts. The slot 80 extending along a helical line can be seen in FIG. 10; it originates from the region of the sleeve 44' in which the latter is connected to an annular flange 60' and extends once round the periphery of the sleeve 44' up to the sleeve end remote from the annular flange 60'.

As shown in the view of FIG. 11 the slot 80 is open at this sleeve end.

As in the embodiment previously described the sleeve 44' is secured against turning on the core with the aid of longitudinal ribs 22, 24, 26 on the core which however in the embodiment of FIGS. 10 and 11 do not engage in longitudinal slots on the sleeve but in longitudinal grooves which are formed in the inner peripheral surface of the sleeve 44'. Longitudinal grooves 88 and 90 are formed in the inner peripheral surface of the sleeve 44' for the noses 18 and 20 formed on the core 10 as well and along said grooves the noses 18, 20 slide when the sleeve 44' is displaced relatively to the core in the axial direction.

The mode of operation of the sleeve according to the embodiment of FIGS. 10 and 11 corresponds to the operation of the embodiment described above and consequently the sleeve 44' moved to the removal position is no longer supported in its interior by the core 10 so that due to the provision of the slot 80 the sleeve 44' can yield radially inwardly so that removal of the roll formed thereon in the axial direction is facilitated.

I claim:

1. Mandrel for coiling tape-shaped material comprising a core including a means for connecting the core to a drive means, said core having proximal and distal ends with respect to the drive means and a sleeve which is non-rotatably mounted in surrounding relationship with respect to said core, said sleeve having proximal and distal ends with respect tot he drive means and being movable on the core between a coiling position and a removal position for removing a roll of the tape-like material formed on the sleeve, where the sleeve is provided with at least one longitudinal slot which is formed int he sleeve and which longitudinally extends in the axial direction of the sleeve, said slot being open at the distal end of the sleeve and terminating at a point spaced from the proximal end of the sleeve so that the sleeve diameter can be at least partially reduced in response to the sleeve being axially moved to a position where the distal end of the sleeve is in non-surrounding relationship with respect to the distal end of the core to thus facilitate said removal of the roll in the removal position, wherein at least one longitudinal rib is disposed on the core for securing the sleeve against rotation and the longitudinal rib is in engagement with said longitudinal slot extending in the axial direction in the sleeve whereby the longitudinal slot in the sleeve facilitates both (a) the reducing of the diameter of the sleeve when the sleeve is moved to the removal position so that the roll of tape-like material can be removed from the sleeve and (b) the non-rotatable mounting of the sleeve with respect to the core due to the engagement of the longitudinal slot by the longitudinal rib on the core.

2. Mandrel according to claim 1, characterized in that in the sleeve two additional longitudinal slots are disposed at an angular interval of about 80° and that the core comprises a flattened portion which when the sleeve is in the coiling position forms with the two additional longitudinal slots a recess for receiving an end of the tape-shaped material to be coiled.

3. Mandrel for coiling tape-shaped material comprising a core including a means for connecting the core including a means for connecting the core at one of its ends to a drive means and a sleeve which is non-rotatabley mounted on said core between a coiling position and a removal position for removing a roll of the tape-like material formed on the sleeve, characterized in that the sleeve is provided with a plurality of longitudinal slots extending in the axial direction of the sleeve where said slots are formed in the sleeve in such a manner that the sleeve diameter can be at least partially reduced in the removal position, wherein a plurality of longitudinal ribs are disposed on the core for securing the sleeve against rotation and the longitudinal ribs extending int he axial direction int he sleeve and further characterized in that in the sleeve two additional longitudinal slots are disposed at an angular interval of about 80° and that the core comprises a flattened portion which when the sleeve is in the coiling position connects the two additional longitudinal slots together and thus forms a recess for receiving an end of the tape-shaped material to be coiled.

4. Mandrel according to claim 3, characterized in that said one guide track is formed by a longitudinal slot in the sleeve.

5. Mandrel according to claims 1 or 3, characterized in that on the core for securing the sleeve against rotation three longitudinal ribs are disposed which are in engagement with three guide tracks in the sleeve.

6. Mandrel according to claim 5, characterized in that adjacent the proximal end of the sleeve an annular flange is disposed having a radius which is greater than the radius of the sleeve.

7. Mandrel according to claim 6, characterized by a securing means which prevents a complete detachment of the sleeve from the core on axial displacement of the sleeve and insures the annular flange is in surrounding relationship with respect to the core regardless of the position of the sleeve with respect to the core.

8. Mandrel according to claim 7, characterized in that the securing means includes at least one nose which projects radially on the core and which engages into a guide track which is formed in the sleeve and is closed at the proximal end of the sleeve associated with the distal end of the core by means of a stop web for the nose.

9. Mandrel according to claim 8, characterized in that at the distal end of the core two diametrically opposite noses are disposed which engage into two further guide tracks in the sleeve.

10. Mandrel for coiling tape-shaped material comprising a core including a means for connecting the core at one of its ends to a drive means and a sleeve which is non-rotatably mounted on said core and is movable on the core between a coiling position and a removal position for removing a roll of the tape-like material formed on the sleeve, characterized in that the sleeve is provided with at least one slot extending along a helical line round the sleeve and which at least one slot is formed in the sleeve such a manner that the sleeve diameter can be at least partially reduced int eh removal position, wherein at least one longitudinal rib is disposed on the core for securing the sleeve against rotation and the longitudinal rib is in engagement with at least one associated guide track extending in the axial direction in the sleeve.

11. Mandrel according to claim 10, characterized in that said one guide track is a longitudinal groove formed in the sleeve inner surface.

12. Mandrel according to claims 1, 3, or 10, characterized by a detent means which is operative between the core and the sleeve and which holds said sleeve with predetermined detent force int he coiling position on the core.

13. Mandrel according to claim 12, characterized in that the detent means consists of a projection on the core and a detent nose disposed on inner surface of the sleeve.

* * * * *